US009022090B2

(12) United States Patent
Cha

(10) Patent No.: US 9,022,090 B2
(45) Date of Patent: May 5, 2015

(54) DOUBLE ROMAN SHADE CURTAIN AND DOUBLE ROMAN SHADE USING THE SAME

(71) Applicant: Daekyeong Triple Co., Ltd., Daegu (KR)

(72) Inventor: Sang-Gun Cha, Daegu (KR)

(73) Assignee: Daekyeong Triple Co., Ltd., Daegu (KR)

( * ) Notice: Subject to any disclaimer, the term of this patent is extended or adjusted under 35 U.S.C. 154(b) by 19 days.

(21) Appl. No.: 13/945,287

(22) Filed: Jul. 18, 2013

(65) Prior Publication Data

US 2014/0367052 A1 Dec. 18, 2014

(30) Foreign Application Priority Data

Jun. 17, 2013 (KR) ..... 10-2013-0069140

(51) Int. Cl.
*E06B 9/262* (2006.01)
*A47H 5/032* (2006.01)

(52) U.S. Cl.
CPC ..... *A47H 5/032* (2013.01); *E06B 9/262* (2013.01); *E06B 2009/2627* (2013.01)

(58) Field of Classification Search
USPC ..... 160/84.01, 84.04, 84.05, 84.06, 178.3, 160/84.03, DIG. 7, 121.1; 139/384 A, 384 R
IPC ..... E06B 2009/2627
See application file for complete search history.

(56) References Cited

U.S. PATENT DOCUMENTS

| | | | | | |
|---|---|---|---|---|---|
| 2,141,038 | A * | 12/1938 | French | 139/384 A |
| 2,142,900 | A * | 1/1939 | Hinlein et al. | 66/170 |
| 2,275,273 | A * | 3/1942 | Taylor | 66/170 |
| 2,295,137 | A * | 9/1942 | Sutton | 160/84.01 |
| 3,160,202 | A * | 12/1964 | Rosen | 160/344 |
| 3,256,928 | A * | 6/1966 | Hensel | 160/178.3 |
| 3,439,725 | A * | 4/1969 | Adams et al. | 160/84.01 |
| 3,478,805 | A * | 11/1969 | Haggard | 160/5 |
| 4,880,044 | A * | 11/1989 | Judkins | 160/84.04 |
| 4,921,032 | A * | 5/1990 | May | 160/84.01 |
| 5,188,160 | A * | 2/1993 | Jelic | 160/84.02 |
| 5,753,338 | A * | 5/1998 | Jelic et al. | 428/116 |
| 5,785,094 | A * | 7/1998 | Yoshida | 139/384 R |
| 6,378,567 | B1 * | 4/2002 | Chen | 139/383 R |
| 6,672,361 | B2 * | 1/2004 | Fransen | 160/85 |
| 6,834,701 | B2 * | 12/2004 | Colson et al. | 160/121.1 |
| 7,694,696 | B2 * | 4/2010 | Chang et al. | 139/423 |
| 8,496,041 | B2 * | 7/2013 | Li | 160/178.3 |
| 2009/0139665 | A1 * | 6/2009 | Cha | 160/87 |
| 2011/0120661 | A1 * | 5/2011 | Kim | 160/89 |

FOREIGN PATENT DOCUMENTS

KR 10-1153854 B1 6/2012

* cited by examiner

*Primary Examiner* — David Purol

(57) ABSTRACT

Disclosed herein is a double roman shade curtain which is configured to include a cord 10, a first curtain 20, a second curtain 30, and a connection belt 40. Further, the present invention relates to a double roman shade which is configured to include a cord 10, a first curtain 20, a second curtain 30, a connection belt 40, a rotating bar 50, a frame 60, and a tow rope 70.

12 Claims, 10 Drawing Sheets

DOUBLE ROMAN SHADE CURTAIN AND DOUBLE ROMAN SHADE USING THE SAME

CROSS REFERENCE TO RELATED APPLICATION

This application claims the benefit of Korean Patent Application No. 10-2013-0069140, filed on Jun. 17, 2013, entitled "DOUBLE ROMAN SHADE CURTAIN AND DOUBLE ROMAN SHADE USING THE SAME", which is hereby incorporated by reference in its entirety into this application.

BACKGROUND OF THE INVENTION

1. Technical Field

The present invention relates to a double roman shade curtain and a double roman shade using the same, and more particularly, to a double roman shade in which a connection belt is provided to be integrally woven and a curtain is formed double, and a double roman shade using the same.

2. Description of the Related Art

A curtain has generally been used to block light or objects in daily life, such as blocking sunlight, covering the stage, or the like. Various kinds of curtains have been used in daily life. For example, there are a general curtain unfolded and folded left and right, a vertical blind consisting of a plurality of pieces of which the tilt angle may be adjustable, a roll screen curtain wound and unwound around a rotating roll, a roman shade folded by a winding operation of a length adjustable string, and the like.

In recent, as people consider functions and esthetic elements of a curtain important, a roman shade with a beautifully folded shape has become popular. Since the roman shade basically forms a plurality of creases as a curtain portion ascends while being folded, the roman shade has a beautiful appearance when it completely ascends.

The roman shade type blind according to the related art is disclosed in Patent Document 1. FIG. 1 is a front view illustrating a roman shade type blind according to the related art and FIG. 2 is a partial side cross-sectional view illustrating the roman shade type blind according to the related art, in which the roman shade type blind according to the related art is configured of a fabric 3, a ring 4, and a cord 5. As illustrated in FIG. 1, the fabric 3 is woven by intersecting warps 1 with wefts 2. Among them, some of the wefts 2 do not intersect the warps 1, and thus the ring 4 is formed. Referring to FIG. 2, the warps 1 do not intersect some of the wefts 2 while the warps 1 intersect the wefts 2 by passing through between the wefts 2, such that the wefts 2 of a portion through which the warps 1 do not pass are collected to form the rings 4. Therefore, the so formed ring 4 passes through the cord 5, such that the roman shade type blind according to the related art is completed.

However, since the roman shade type blind according to the related art separately forms the ring 4 so as to connect the cord 5 to the fabric 3, some of the wefts 2 need not to intersect the warps 1, which leads to a complicated weaving process.

Further, since some of the wefts 2 do not intersect the warps 1 in order to form the ring 4, durability of the corresponding portion may be weakened.

Further, the cord 5 is generally made of a transparent, thin, and hard material so as not to be seen well in the appearance even though the cord 5 is exposed to the outside. In this case, owing to the structure in which the cord 5 is exposed to the outside, the accidents that the cord 5 is wound around a child's hand or neck during playing may occur.

RELATED ART DOCUMENT

Patent Document (Patent Document 1) KR 10-1153854 B1 (Jun. 18, 2012)

SUMMARY OF THE INVENTION

An object of the present invention is to provide a double roman shade curtain in which a cord directly passes through a curtain, a connection belt is provided to be integrally woven, and a curtain is formed double, and a double roman shade using the same.

According to an exemplary embodiment of the present invention, there is provided a double roman shade curtain, including: a cord; a first curtain including a first weft and a first warp intersecting the first weft and having the cord partially passing between the first wefts; a second curtain including a second weft and a second warp intersecting the second weft and disposed to face the first curtain; a connection belt formed between the first curtain and the second curtain along a horizontal direction, connecting the first curtain with the second curtain, and having the cord passing therethrough, wherein the cord is fixed to a lower portion of the first curtain and the second curtain.

According to an exemplary embodiment of the present invention, there is provided a double roman shade, including: a cord; a first curtain including a first weft and a first warp intersecting the first weft and having the cord partially passing between the first wefts; a second curtain including a second weft and a second warp intersecting the second weft and disposed to face the first curtain; a connection belt formed between the first curtain and the second curtain along a horizontal direction, connecting the first curtain with the second curtain, and having the cord passing therethrough; a rotating bar fixed with one end of the cord; a frame having a rotating shaft of both ends of the rotating bar connected to both ends thereof and having an upper portion of the first curtain and the second curtain fixed thereto; and a tow rope adjusting a rotation of the rotating bar, wherein the cord is fixed to a lower portion of the first curtain and the second curtain.

DESCRIPTION OF THE EXEMPLARY EMBODIMENTS

Hereinafter, a double roman shade curtain and a double roman shade using the same according to an exemplary embodiment of the present invention will be described in more detail with reference to the accompanying drawings.

Figure 1:
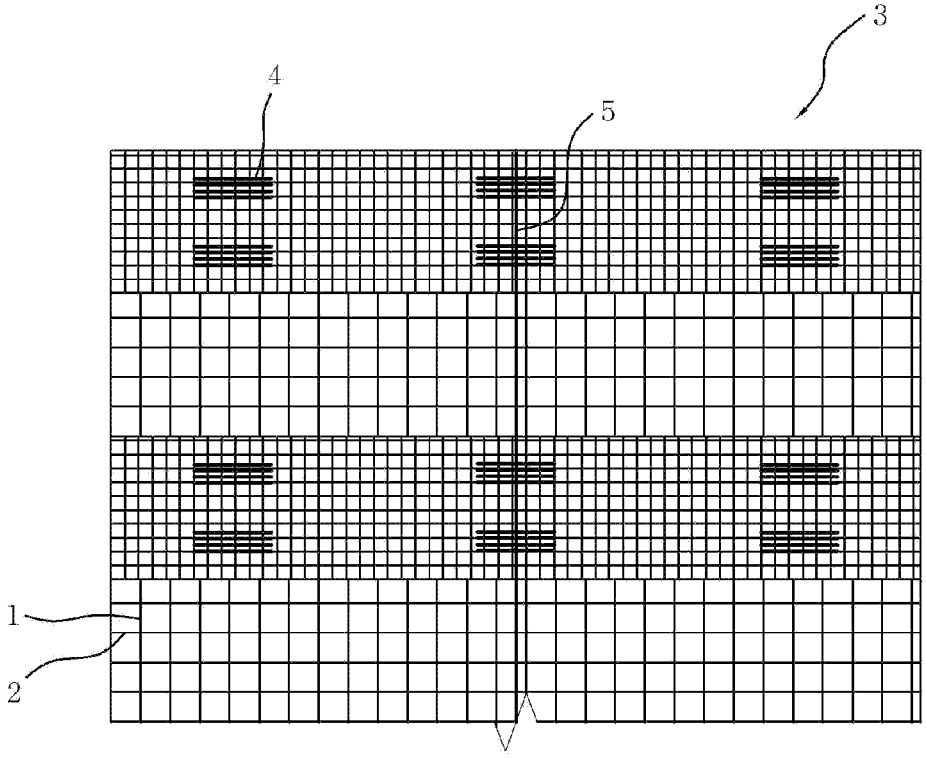
FIG. 1 is a front view illustrating a roman shade type blind according to the related art.
Figure 2:
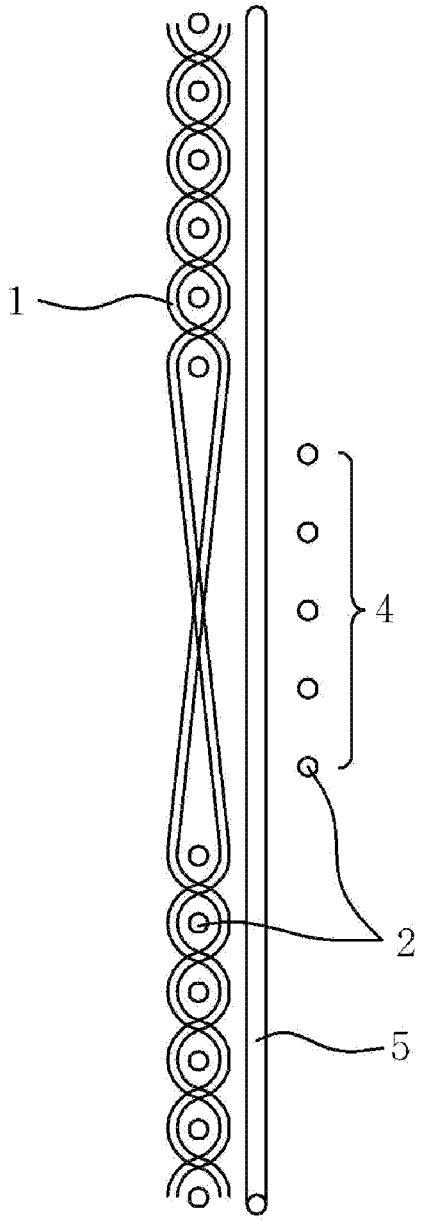
FIG. 2 is a partial side cross-sectional view illustrating the roman shade type blind according to the related art.
Figure 3:
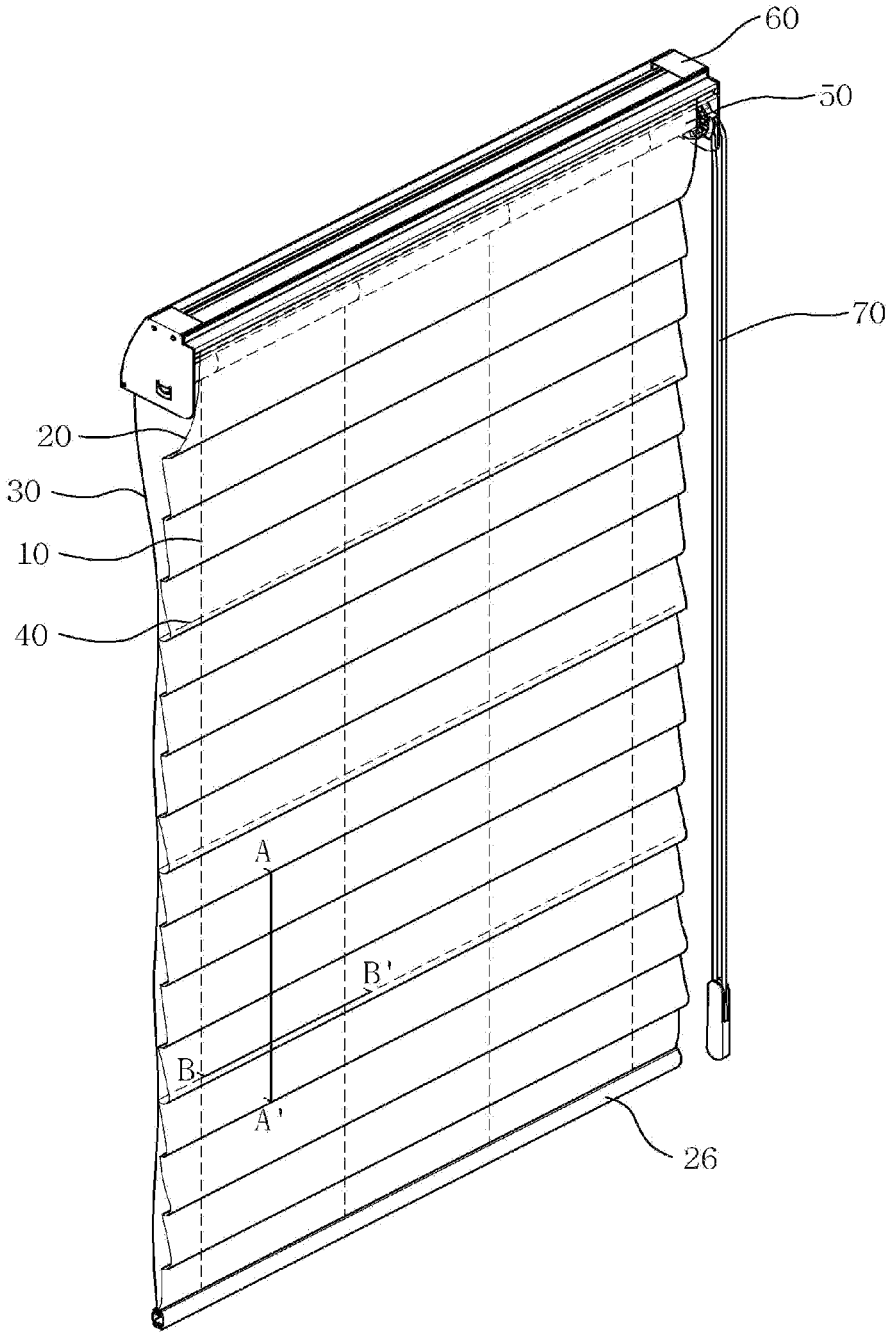
FIG. 3 is a perspective view illustrating a double roman shade according to an exemplary embodiment of the present invention.
Figure 4:
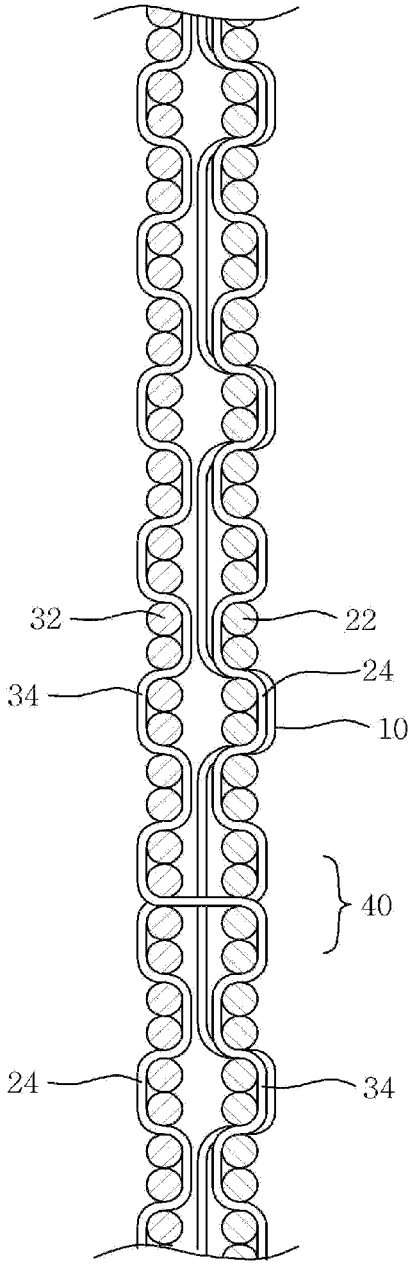
FIG. 4 is a cross-sectional view of A-A' of FIG. 3 illustrating first and second curtains according to a first exemplary embodiment of the present invention.
Figure 5:
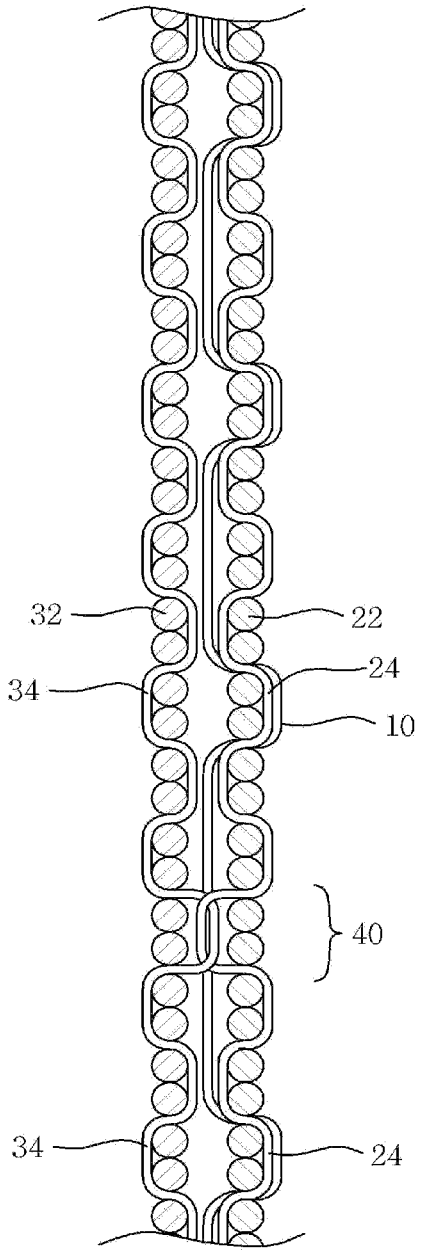
FIG. 5 is a cross-sectional view of A-A' of FIG. 3 illustrating first and second curtains according to a second exemplary embodiment of the present invention.
Figure 6:
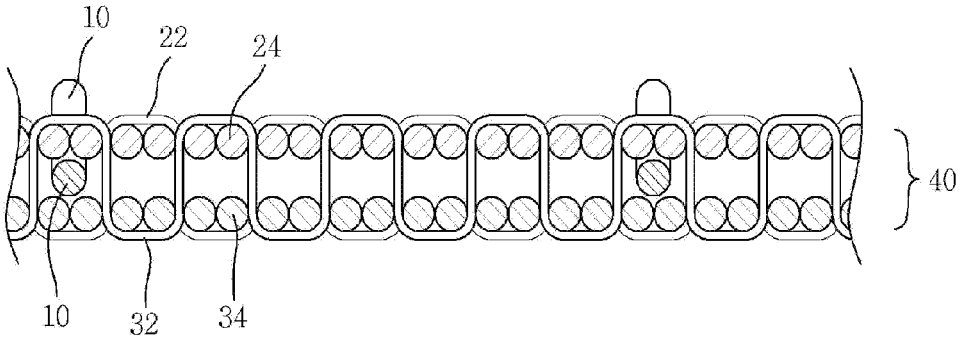
FIG. 6 is a cross-sectional view of B-B' of FIG. 3 illustrating first and second curtains according to a third exemplary embodiment of the present invention.

The present invention relates to a double roman shade curtain and a double roman shade using the same. FIG. 3 is a perspective view illustrating a double roman shade according to an exemplary embodiment of the present invention, FIG. 4 is a cross-sectional view of A-A' of FIG. 3 illustrating first and second curtains according to a first exemplary embodiment of the present invention, FIG. 5 is a cross-sectional view of A-A' of FIG. 3 illustrating first and second curtains according to a second exemplary embodiment of the present invention, and FIG. 6 is a cross-sectional view of B-B' of FIG. 3 illustrating first and second curtains according to a third exemplary embodiment of the present invention.

The double roman shade curtain according to the exemplary embodiment of the present invention is configured to include a cord 10, a first curtain 20 including a first weft 22 and a first warp 24 intersecting the first weft 22 and having the cord 10 partially passing between the first wefts 22, a second curtain 30 including a second weft 32 and a second warp 34 intersecting the second weft 32 and disposed to face the first curtain 20, and a connection belt 40 formed between the first curtain 20 and the second curtain 30 along a horizontal direction, connecting the first curtain 20 with the second curtain 30, and having the cord 10 passing therethrough.

Further, the double roman shade according to the exemplary embodiment of the present invention is configured to include a cord 10, a first curtain 20 including a first weft 22 and a first warp 24 intersecting the first weft 22 and having the cord 10 partially passing between the first wefts 22, a second curtain 30 including a second weft 32 and a second warp 34 intersecting the second weft 32 and disposed to face the first curtain 20, and a connection belt 40 formed between the first curtain 20 and the second curtain 30 along a horizontal direction, connecting the first curtain 20 with the second curtain 30, and having the cord 10 passing therethrough, and a rotating bar 50 to which one end of the cord 10 is fixed, a frame 60 having a rotating shaft of both ends of the rotating bar 50 connected to both ends thereof and having an upper portion of the first curtain 20 and the second curtain 30 fixed thereto, and a tow rope 70 adjusting a rotation of the rotating bar 50.

Each component will be described below.

The cord 10 is a component to serve as the double roman shade curtain according to the exemplary embodiment of the present invention and as illustrated in FIG. 3, has the rotating bar 50 to be described below fixed to one end thereof and the lower portion of the first curtain 20 and the second curtain 30 to be described below fixed to the other end thereof.

The first curtain 20 consists of the first weft 22 and the first warp 24 and the first curtain 20 is woven by intersecting the first weft 22 with the first warp 24. Further, the cord 10 passes through a plurality of the first wefts 22 at a predetermined interval and a length of a crease is determined as much as a length of the predetermined interval. When the cord 10 passes through the first weft 22 at the same interval at the front and back surfaces, the crease is formed in both surfaces and if necessary, the cord 10 passes through the front surface longer and the back surface shorter, such that the crease may be formed only the front surface.

The cord 10 pulls up the lower portion of the first curtain 20 and the second curtain 30 to form the crease at the first curtain 20, such that the double roman shade according to the exemplary embodiment of the present invention may be provided with a crease without the separate ring.

A tension holding bar 26 is an additional component of the double roman shade according to the exemplary embodiment of the present invention and as illustrated in FIG. 3, the tension holding bar 26 has a predetermined weight and is disposed at the lower portion of the first curtain 20 and the second curtain 30 to apply gravity to the curtains so as to allow the curtains to less sway from external impact and be stably disposed.

The second curtain 30 includes the second weft 32 and the second warp 34 intersecting the second weft 32 and as illustrated in FIG. 3, is disposed to face the first curtain 20.

The connection belt 40 is formed between the first curtain 20 and the second curtain 30 along a horizontal direction to serve to connect the first curtain 20 with the second curtain 30. Further, the connection belt 40 is not formed using a separate yarn, but is formed by intersecting the first and second wefts 22 and 32 with the first and second warps 24 and 34.

Further, the other end of the cord 10 passing through the first weft 22 passes through the connection belt 40 and then is fixed to the lower portion of the first curtain 20 and the second curtain 30, such that the first curtain 20 and the second curtain 30 may be simultaneously formed with creases. Since the cord 10 partially passes through the first weft 22 of the first curtain 20, the size and number of creases formed at the first curtain 20 and creases formed at the second curtain 30 are different. In this case, the ratio of the creases formed at the first curtain 20 and the second curtain 30 using the cord 10 may be different and when the cord 10 passes through the first weft 22 twice and passes through the connection belt 40, the cord 10 is pulled to form two creases at the first curtain 20 and one crease at the second curtain 30. In detail, when the cord 10 passes through the connection belt 40, the first curtain 20 and the second curtain 30 each are basically formed with one crease and the outer side of the first curtain 20 is further formed with one crease every time the cord 10 passes through the first weft 22 twice. According to the exemplary embodiment of the present invention, as illustrated in FIG. 3, the cord 10 passes through the first weft 22 six times and then passes through the connection belt 40 once. Therefore, when the second curtain 30 is formed with one crease, the first curtain 20 is formed with four creases. This is only one exemplary embodiment, and if necessary, the ratio of the creases may be different by variously forming the number of cords 10 passing through the first weft 22.

Therefore, since the curtain is provided double and the creases are formed in both surfaces, the double roman shade according to the exemplary embodiment of the present invention has a beautiful appearance and the creases formed at the first curtain 20 and the second curtain 30 are formed asymmetrically.

Meanwhile, the cord 10 is disposed between the first curtain 20 and the second curtain 30 to be little exposed to the outside and the exposed portion is also a portion of partially passing through the first curtain 20 and is just a few. Further, the cord 10 partially passes through the first curtain 20 to allow a child to make an available length of the cord 10 winding an object short, such that the accidents that the child winds parts of his body with the cord 10 may be effectively prevented. Further, the cord 10 is provided in plural along a horizontal direction, such that the double roman shade according to the exemplary embodiment of the present invention may be stably operated.

Hereinafter, the first curtain 20 and the second curtain according to the exemplary embodiment of the present invention will be described with reference to FIGS. 4 to 6.

According to the first exemplary embodiment of the present invention, as illustrated in FIG. 4, the first warp 24 descends while intersecting the first weft 22 and then intersects the second weft 32. By the same manner, the second warp 34 descends while intersecting the second weft 32 and then intersects the first weft 22 at a position at which the first warp 24 intersects the second weft 32. Therefore, the first curtain 20 and the second curtain 30 are connected to each other by intersecting the warps and a portion at which the first warp 24 and the second warps 34 intersect each other is the connection belt 40.

According to the first exemplary embodiment of the present invention, even though the thickness of yarns of the first warp 24 and the second warp 34 or the thickness of yarns of the first weft 22 and the second weft 32 is used differently, the curtain may be woven without being bent in one direction. That is, when the curtain is woven with each yarn in the state in which a thickness of a yarn used for the first curtain 20 and a thickness of a yarn used for the second curtain 30 are different, the size the first curtain 20 and the second curtain 30 is different, such that the first exemplary embodiment of the present invention may solve the above problem by intersecting the yarns during the operation.

According to the second exemplary embodiment, as illustrated in FIG. 5, the first warp 24 descends while intersecting the first weft 22 and the second warp 34 descends while intersecting the second weft 32 and then the first warp and the second warp 34 are twisted at a predetermined position. Then, the first warp 24 intersects the first weft and the second warp 34 intersects the second weft 32. Therefore, the first curtain 20 and the second curtain 30 are connected to each other by twisting the warps and a portion at which the first warp 24 and the second warp 34 are twisted is the connection belt 40.

According to the exemplary embodiment of the present invention, as illustrated in FIG. 6, the first weft 22 intersects the first and second warps 24 and 34 and the first weft 32 intersects the first and second warps 24 and 34. That is, the first weft 22 and the second weft 32 intersect the first and second warps 24 and 34 while intersecting each other and the portion at which the first weft 22 and the second weft 32 intersect each other is the connection belt 40. Unlike the first and second exemplary embodiments of the present invention, since the third exemplary embodiment of the present invention forms the connection belt 40 by the intersection of the wefts, the number of intersecting wefts increases and thus the thickness of the connection belt 40 may be adjusted. Therefore, the first curtain 20 and the second curtain 30 may be more firmly connected to each other and the crease form of the double roman shade according to the exemplary embodiment of the present invention may be variously adjusted.

As described above, the connection belt 40 may be formed by various methods and if necessary, is formed in plural along a vertical direction, such that the crease of the double roman shade according to the exemplary embodiment of the present invention may be formed in plural.

The rotating bar 50 is an element rotating to operate the double roman shade according to the exemplary embodiment of the present invention and the rotating shaft is connected with the frame 60 to be described below. Further, the rotating bar 50 is connected with one end of the cord 10 and thus the cord 10 is wound or unwound by rotating the rotating bar 50.

As illustrated in FIG. 3, both ends of the frame 60 are connected with the rotating shaft of both ends of the rotating bar 50 and thus the rotating bar 50 may rotate to the frame 60. The frame 60 is attached at a position at which the double roman shade according to the exemplary embodiment of the present invention is installed.

The tow rope 70 is wound around one end of the rotating bar 50 to serve to adjust the rotation of the rotating bar 50.

Figure 7:
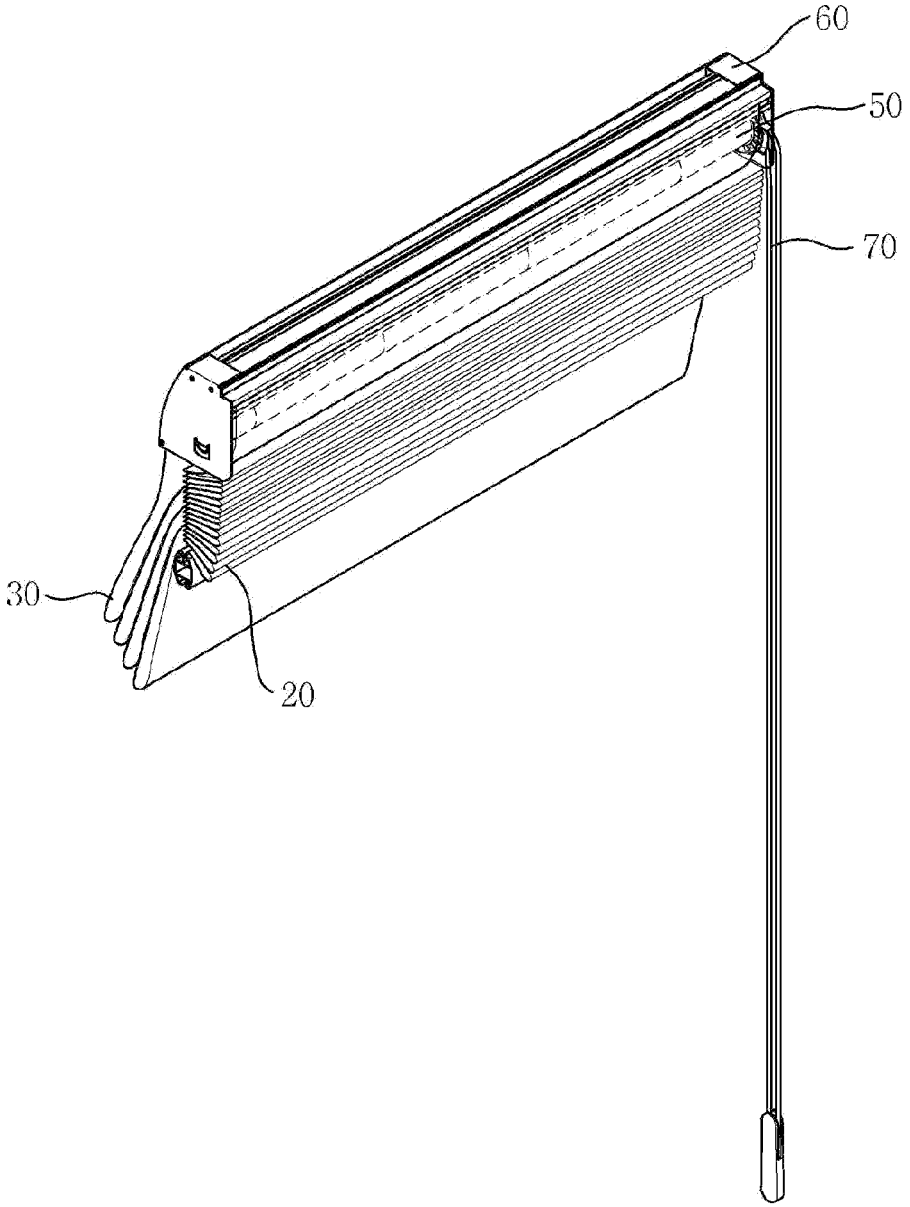
FIG. 7 is a perspective view illustrating an operational state of the double roman shade according to the exemplary embodiment of the present invention.

Hereinafter, the operational state of the double roman shade according to the exemplary embodiment of the present invention will be described in more detail with reference to the accompanying drawings. FIG. 7 is a perspective view illustrating the operational state of the double roman shade according to the exemplary embodiment of the present invention.

When the rotating bar 50 rotates through the tow rope 70, the first curtain 20 and the second curtain 30 start to ascend from below while the cord 10 is wound around the rotating bar 50. In this case, the first curtain 20 is formed with creases in proportion to the number of cords passing through the first weft 22 of the first curtain 20 and when the lower portion of the first curtain 20 and the second curtain 30 is folded with the connection belt 40, the first curtain 20 and the second curtain 30 are simultaneously formed with creases. Further, when the cord 10 is completely wound around the rotating bar 50, the creases of the second curtain 30 are formed as many as the number of connection belts 40 formed as illustrated in FIG. 7 and the creases are formed in proportion to the number of connection belts 40 formed at the first curtain 20 and the number of passing cords 100.

Figure 8A:
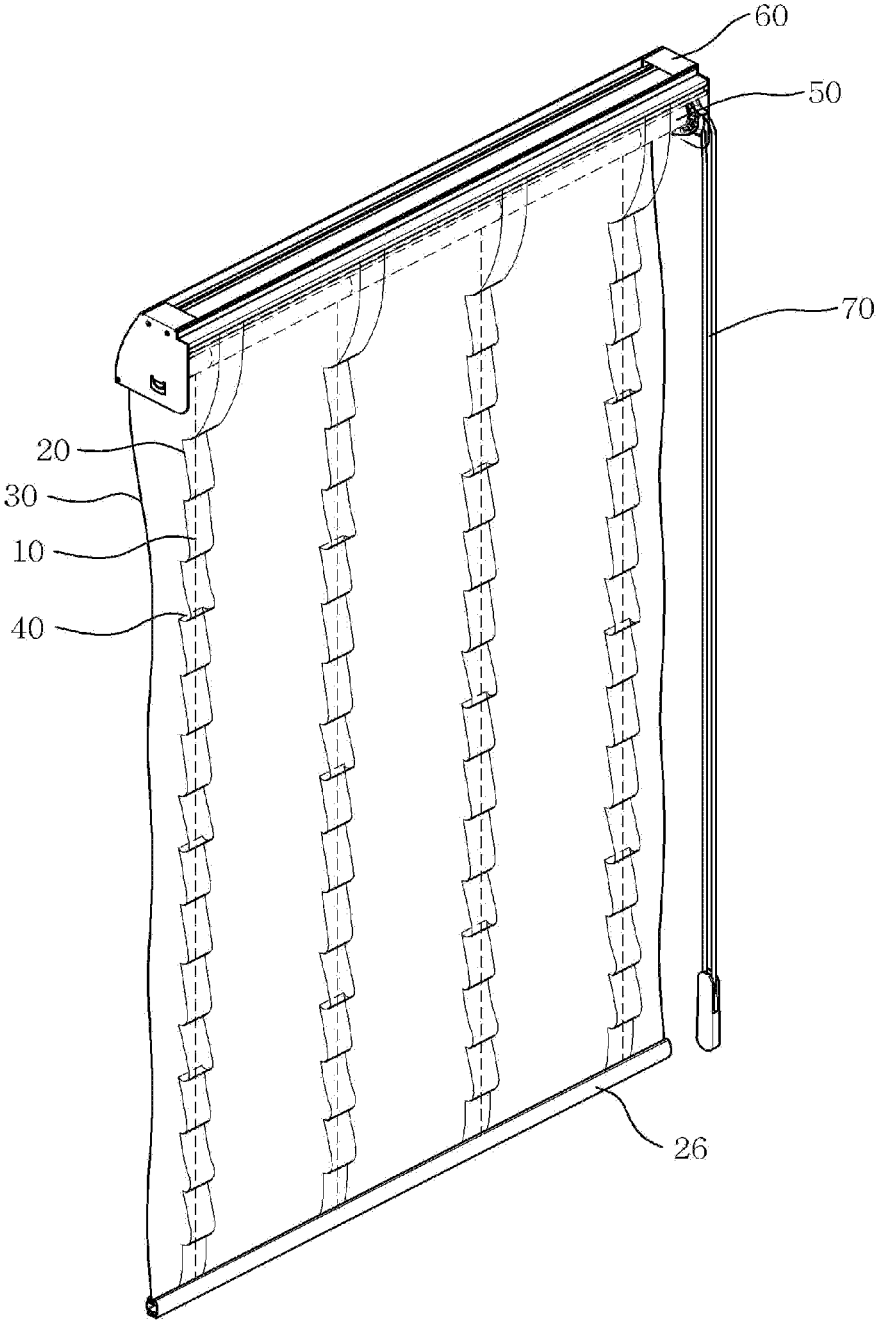
FIG. 8A is a perspective view illustrating the unfolded double roman shade according to the exemplary embodiment of the present invention.
Figure 8B:
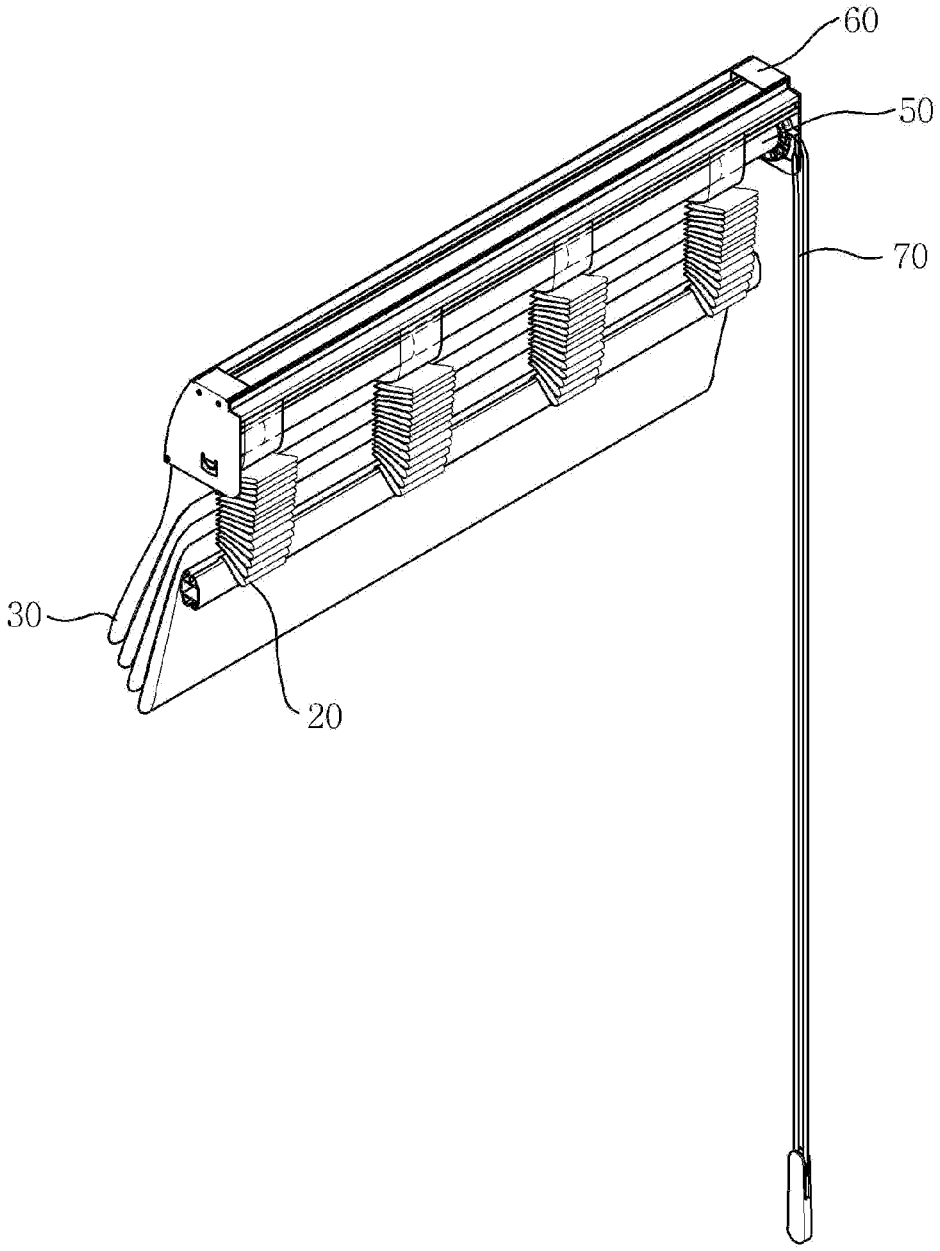
FIG. 8B is a perspective view illustrating the folded double roman shade according to the exemplary embodiment of the present invention.

FIG. 8A is a perspective view illustrating the unfolded double roman shade according to the exemplary embodiment of the present invention and FIG. 8B is a perspective view illustrating the folded double roman shade according to the exemplary embodiment of the present invention.

According to the double roman shade according to the exemplary embodiment of the present invention, the first curtain 20 may be partially subjected to shearing and preferably, as illustrated in FIG. 8A, the remaining portion other than the portion through which cord 10 directly passes is subjected to shearing. This is to prevent creases from being irregularly formed at the first curtain 20 when the interval between the cords 10 is expanded. Further, this may reduce the quantity of used yarn.

Further, when the cord 10 is wound around the rotating bar 50 using the tow rope 70, as illustrated in FIG. 8B, the sheared first curtain 20 is folded by forming creases.

Figure 9:
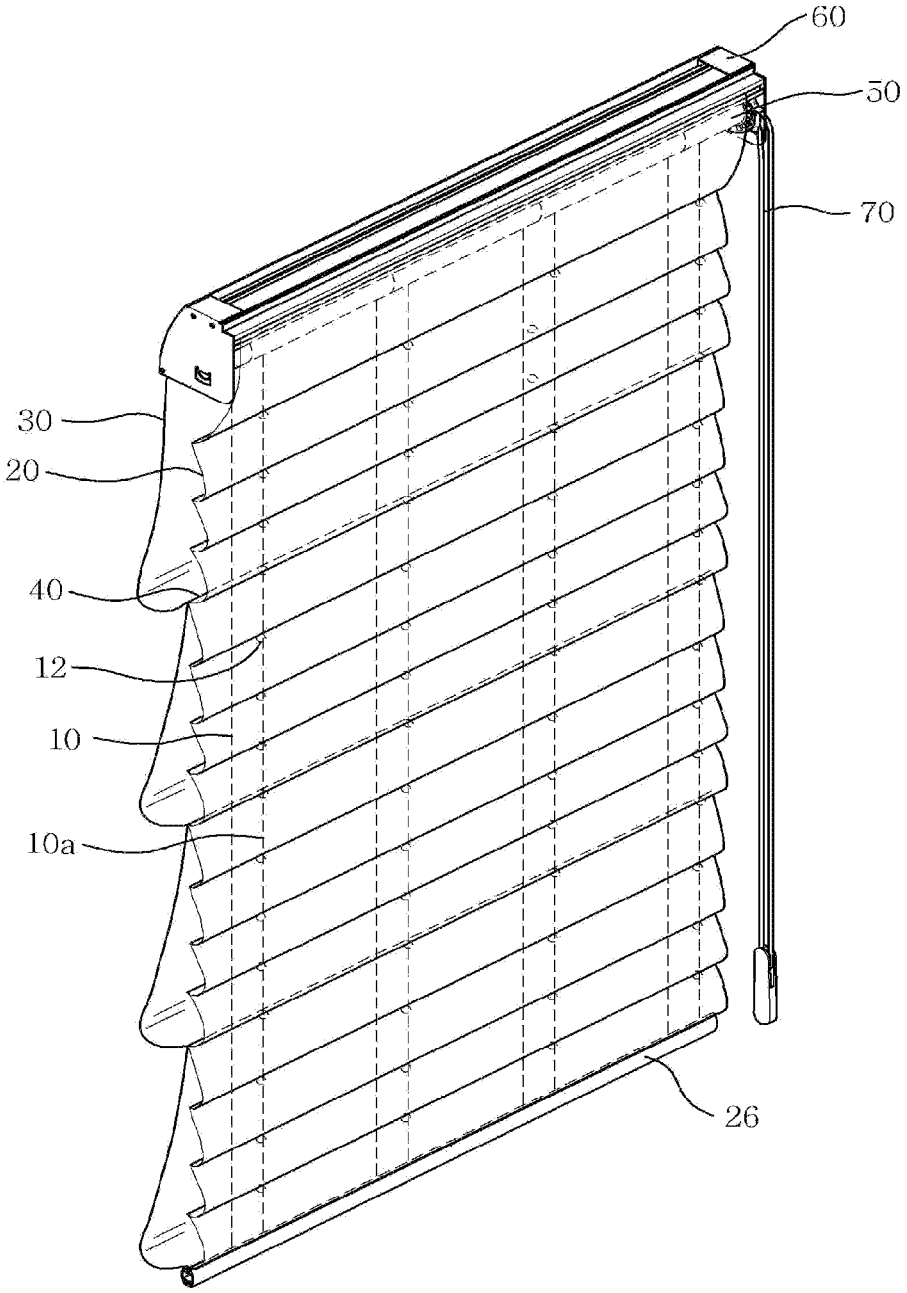
FIG. 9 is a perspective view illustrating a fixed bead according to an exemplary embodiment of the present invention.

FIG. 9 is a perspective view illustrating a fixed bead according to an exemplary embodiment of the present invention.

The fixed bead 12 is a bead formed with a through hole and as illustrated in FIG. 9, is fixed on auxiliary cords 10*a* fixed to the lower and upper portions of the first curtain 20, such that when the curtains are unfolded, the fixed bead 42 is hung on the first weft 22, the curtains are no more unfolded and the creases are formed.

As set forth above, according to the exemplary embodiments of the present invention, the double roman shade curtain and the double roman shade using the same can be integrally woven without forming the separate ring and can prevent accidents that the cord is wound around children.

Further, the roman shade can be formed in both surfaces, thereby having the beautiful appearance, forming the different patterns of creases on both surfaces, and having the excellent durability.

What is claimed is:

1. A double roman shade curtain, comprising:

a first curtain including a first weft and a first warp intersecting the first weft;

a second curtain including a second weft and a second warp intersecting the second weft and disposed to face the first curtain; and a plurality of connection belts disposed between the first curtain and the second curtain along a horizontal direction and connecting the first curtain with the second curtain, the plurality of connection belts being spaced at a first interval;

a cord that passes through the second curtain at a second interval that is shorter than the first interval, the cord passing through the plurality of connection belts, wherein the cord is fixed to a lower portion of the first curtain and a lower portion of the second curtain.

2. The double roman shade curtain of claim 1, wherein the first warp intersects the second weft, the second warp partially intersects the first weft, and the first warp and the second warp intersect at the connection belt.

3. The double roman shade curtain of claim 1, wherein the first warp and the second warp are twisted at the connection belt.

4. The double roman shade curtain of claim 1, wherein the first weft intersects the first and second warps, the second weft intersects the first and second warps, and the first and second wefts intersect each other at the connection belt.

5. The double roman shade curtain of claim 1, further comprising at least one additional cord.

6. A double roman shade, comprising:

a first curtain including a first weft and a first warp intersecting the first weft;

a second curtain including a second weft and a second warp intersecting the second weft and disposed to face the first curtain;

a plurality of connection belts disposed between the first curtain and the second curtain along a horizontal direction and connecting the first curtain with the second curtain, the plurality of connection belts being spaced apart at a first interval;

a cord that passes through the first curtain at a second interval that is greater than the first interval, the cord passing through the plurality of connection belts, a rotating bar fixed with one end of the cord;

a frame having a rotating shaft connected to both ends of the rotating bar, the frame being attached to an upper portion of the first curtain and an upper portion of the second curtain; and a tow rope adjusting a rotation of the rotating bar, wherein the cord is fixed to a lower portion of the first curtain and a lower portion of the second curtain.

7. The double roman shade of claim 6, wherein the first warp intersects the second weft, the second warp partially intersects the first weft, and the first warp and the second warp intersect each other at the connection belt.

8. The double roman shade of claim 6, wherein the first warp and the second warp are twisted at the connection belt.

9. The double roman shade of claim 6, wherein the first weft intersects the first and second warps, the second weft intersects the first and second warps, and the first and second wefts and intersect each other at the connection belt.

10. The double roman shade of claim 6, further comprising at least one additional cord.

11. The double roman shade of claim 6, further comprising:

an auxiliary cord having an upper portion of the first curtain or the second curtain fixed to one end thereof and passing through the connection belt to have a lower portion of the first curtain and the second curtain fixed to the other end thereof, wherein the auxiliary cord is further provided with a fixed bead.

12. A double roman shade, comprising:

a first curtain including a first weft woven through a first warp, the first curtain including creases spaced at a first interval;

a second curtain including a second weft woven through a second warp;

a plurality of connection belts each attached to the second curtain at a second interval that is greater than the first interval, the connection belts connecting the first curtain to the second curtain; and a cord substantially perpendicular to the folds and woven through the creases of the first curtain, the cord passing through the connection belts.

* * * * *